US010348032B2

(12) United States Patent
Yamaguchi et al.

(10) Patent No.: US 10,348,032 B2
(45) Date of Patent: Jul. 9, 2019

(54) CONNECTOR

(71) Applicant: JAPAN AVIATION ELECTRONICS INDUSTRY, LIMITED, Tokyo (JP)

(72) Inventors: Takahiro Yamaguchi, Tokyo (JP); Masaki Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/878,752

(22) Filed: Jan. 24, 2018

(65) Prior Publication Data

US 2018/0261956 A1 Sep. 13, 2018

(30) Foreign Application Priority Data

Mar. 13, 2017 (JP) ..... 2017-047679

(51) Int. Cl.
*H01R 4/02* (2006.01)
*H01R 12/53* (2011.01)
(Continued)

(52) U.S. Cl.
CPC ..... *H01R 13/5804* (2013.01); *H01R 4/027* (2013.01); *H01R 12/53* (2013.01);
(Continued)

(58) Field of Classification Search
CPC .... H01R 24/50; H01R 43/24; H01R 13/5845; H01R 2103/00; H01R 13/658;
(Continued)

(56) References Cited

U.S. PATENT DOCUMENTS 5,618,202 A * 4/1997 Okuyama ..... H01R 12/596 439/497
8,480,421 B2 * 7/2013 Yoshioka ..... H01R 43/24 439/275

(Continued)

FOREIGN PATENT DOCUMENTS

CN 1318883 A 10/2001
CN 202142718 U 2/2012

(Continued)

OTHER PUBLICATIONS

Office Action issued in Republic of Korea Counterpart Patent Appl. No. 10-2018-0014080 dated Jan. 21, 2019, along with an English translation thereof.

(Continued)

*Primary Examiner* — Gary F Paumen
(74) *Attorney, Agent, or Firm* — Greenblum & Bernstein, P.L.C.

(57) ABSTRACT

A connector that is attached to ends of cables includes a substrate and a locator that is connected to the substrate. The substrate includes two electrode arrays and a positioning portion and the locator includes two through hole arrays and a positioning portion. Each of signal cable(s) of a shielded cable and cables other than the shielded cable is inserted through one corresponding through hole among through holes. The substrate and the locator are mutually positioned by the positioning portions thereof. Each of conductive wire(s) included in the signal cable(s) of the shielded cable and conductive wire(s) included in the cable(s) other than the shielded cable is connected to one corresponding electrode among electrodes. The cables are fixed to the locator with an adhesive which is applied to one part of the locator. An end of a shielding material which covers the signal cable is positioned in the vicinity of the locator.

16 Claims, 10 Drawing Sheets

(51) Int. Cl.

| | |
|---|---|
| ***H01R 13/58*** | (2006.01) |
| ***H01R 13/66*** | (2006.01) |
| ***H01R 24/60*** | (2011.01) |
| ***H01R 24/64*** | (2011.01) |
| ***H01R 107/00*** | (2006.01) |
| ***H01R 13/6593*** | (2011.01) |

(52) U.S. Cl.
CPC ..... *H01R 24/64* (2013.01); *H01R 13/5808* (2013.01); *H01R 13/6593* (2013.01); *H01R 13/6658* (2013.01); *H01R 24/60* (2013.01); *H01R 2107/00* (2013.01)

(58) Field of Classification Search
CPC ..... H01R 13/405; H01R 13/5804; H01R 13/5808; H01R 13/6593; H01R 13/6658; H01R 24/60; H01R 24/64; H01R 2107/00; H01R 4/027; H01R 12/53
USPC ..... 439/579, 581, 604, 606
See application file for complete search history.

(56) References Cited

U.S. PATENT DOCUMENTS

| | | | | |
|---|---|---|---|---|
| 8,979,582 | B2 * | 3/2015 | Tanaka | H01R 13/5205 439/587 |
| 9,136,646 | B2 | 9/2015 | Naito et al. | |
| 2001/0031579 | A1 | 10/2001 | Fujino et al. | |
| 2003/0064625 | A1 * | 4/2003 | Ozai | H01R 9/032 439/579 |
| 2011/0059643 | A1 | 3/2011 | Kuwahara et al. | |
| 2012/0252266 | A1 * | 10/2012 | Ling | H01R 9/038 439/581 |
| 2013/0210272 | A1 * | 8/2013 | Yuan | H01R 9/0515 439/581 |
| 2016/0079689 | A1 * | 3/2016 | Wu | B23K 1/0016 439/581 |
| 2016/0093991 | A1 * | 3/2016 | Kobayashi | H01R 24/50 439/579 |
| 2017/0018864 | A1 * | 1/2017 | Masuyama | H05K 1/18 |

FOREIGN PATENT DOCUMENTS

| | | |
|---|---|---|
| CN | 204205198 | 3/2015 |
| CN | 103855511 B | 8/2016 |
| JP | 2009-076375 | 4/2009 |
| JP | 2017-027660 A | 2/2017 |
| KR | 10-1585122 | 1/2016 |

OTHER PUBLICATIONS

Chinese 1st Office Action dated Mar. 20, 2019 of Application or Patent No. 201810082455.0.

* cited by examiner

CONNECTOR

TECHNICAL FIELD

The present invention relates to a connector which is attached to ends of cables.

BACKGROUND ART

When a connector is attached to ends of cables, the cables need to be aligned so as to facilitate connection work of the cables.

FIG. 1 illustrates the configuration described in Japanese Patent Application Laid Open No. 2017-27660 as a conventional example of a cable alignment component for aligning cables. A cable alignment component 10 is used to space out ground cables and coaxial cables and to connect these cables to electrodes provided on a substrate.

The cable alignment component 10 includes eight cable through holes 11 for inserting coaxial cables and two ground cable through holes 12 for inserting ground cables, and an opening portion 13 is formed in the middle of the through holes.

FIGS. 2 and 3A to 3D illustrate a state that the cable alignment component 10 is attached to a substrate 30. Coaxial cables 21 are respectively inserted into the cable through holes 11 and ground cables 22 are respectively inserted into the ground cable through holes 12. After that, an adhesive is injected into the opening portion 13 so as to fix the coaxial cables 21 and the ground cables 22. Further, termination processing is performed with respective to each of the coaxial cables 21 and the ground cables 22.

Eight electrodes 31 arranged in a row, a ground electrode 32, and two position reference portions 33 are formed on the substrate 30. The two position reference portions 33 are holes. The ground electrode 32 is a strip electrode and is disposed in parallel with the row of the electrodes 31.

The cable alignment component 10 is disposed on a position of an aligned component attachment portion 34 of the substrate 30. A recessed portion 14 is formed in the bottom portion of the cable alignment component 10. The bottom portion of the cable alignment component 10 is a portion which comes into contact with the aligned component attachment portion 34. Two position determining portions 15 which are projecting portions are formed on the cable alignment component 10. By inserting the position determining portions 15 into the position reference portions 33 respectively, the cable alignment component 10 is attached to a predetermined position of the substrate 30.

Each of conductive wires 22*a* of the ground cables 22 is soldered to the ground electrode 32. Each of outer conductors 21*a* of the coaxial cables 21 is also soldered to the ground electrode 32. With respect to each of the coaxial cables 21, each of central conductors 21*b* of the coaxial cable 21 is soldered to a corresponding one of the electrodes 31. Use of the cable alignment component 10 facilitates a process from a step for arranging coaxial cables 21 in a plane to a step for connecting the coaxial cables 21 to the electrodes 31 on the substrate 30.

In this example, the dimension in the vertical direction of the cable through hole 11 on the side of the electrode 31, where the vertical direction is the direction parallel to the normal direction of the substrate 30, is larger than the dimension in the vertical direction of the cable through hole 11 on the side opposite to the electrode 31. Therefore, despite the presence of the opening portion 13, insertion of the coaxial cables 21 into the cable through holes 11 is easy.

Incidentally, a connector can be attached also to an end of a cable which is neither a signal cable in which one conductive wire is coated nor a coaxial cable. For example, a connector can be attached also to an end of a cable in which one or more signal cables are shielded with a shielding material using metal foil (hereafter, this cable is referred to as a shielded cable).

Metal foil used for the shielding material of the shielded cable is, for example, aluminum foil or copper foil. The metal foil is formed on a film made of polyethylene terephthalate (PET), for example. The shielding material has a tape shape. The shielding material is spirally wound around one or more signal cables. The signal cable included in the shielded cable is, for example, a twisted pair wire, a twin-coaxial wire, or a single signal cable. The metal foil of the shielding material may be connected to the ground or does not have to be connected.

When a connector is attached to ends of cables (here, at least one of the cables is a shielded cable), the following problems (1) and (2) arise in the case where the cable alignment component 10 of related art is used for aligning the cables.

(1) When the signal cable in the shielded cable is attached to the cable alignment component 10 with the shielding material peeled off, shielding performance is deteriorated because there is a part with no shielding material in the entire length of the opening portion 13 and the cable through holes 11.

(2) When the shielded cable is inserted into the cable through hole 11 in a manner to be coated with the shielding material, deterioration of the shielding performance can be avoided. However, it is difficult to insert the shielded cable into the cable through hole 11 with the tape-shaped shielding material wound, requiring a lot of man-hour. In addition, peeling of the shielding material starts from a portion where the shielding material collides with an entrance of the cable through hole 11 and thus, a defect of a harness product is generated.

SUMMARY OF THE INVENTION

An object of the present invention is to provide a connector favorable to attachment to ends of cables including a shielded cable, in view of such problems.

A connector according to the present invention is a connector that is attached to ends of cables. At least one of the cables is a shielded cable in which one or more signal cables are shielded with a shielding material using metal foil.

The connector includes a substrate that is connected to a fitting portion for connecting with a mating connector of the connector, and a locator that is connected to the substrate.

The substrate includes at least one electrode array and a positioning portion. In each of the at least one electrode array, electrodes are arranged in a row.

The locator includes at least one through hole array and a positioning portion. In each of the at least one through hole array, through holes are arranged in a row.

Each of the signal cable(s) of the shielded cable and the cable(s) other than the shielded cable is inserted through one corresponding through hole among the through holes.

The substrate and the locator are mutually positioned by the positioning portion of the substrate and the positioning portion of the locator.

Each of conductive wire(s) included in the signal cable(s) of the shielded cable and conductive wire(s) included in the cable(s) other than the shielded cable is connected to one corresponding electrode among the electrodes.

The cables are fixed to the locator with an adhesive which is applied to one part of the locator. With respect to the locator, the one part is positioned on a side opposite to another part of the locator, which faces the at least one electrode array.

An end of the shielding material is positioned in a vicinity of the locator.

Effects of the Invention

Since the shielding material can be brought close to electrodes while preventing a short circuit between the electrodes and the shielding material, the connector according to the present invention is favorable to attachment to ends of cables including a shielded cable.

DETAILED DESCRIPTION OF THE EMBODIMENT

Embodiments of the present invention will be described with reference to the accompanying drawings.

FIGS. 4 and 5A to 5C illustrate an embodiment of a connector according to the present invention. A connector 100 is attached to an end of a composite cable 200 including cables.

Figure 1:
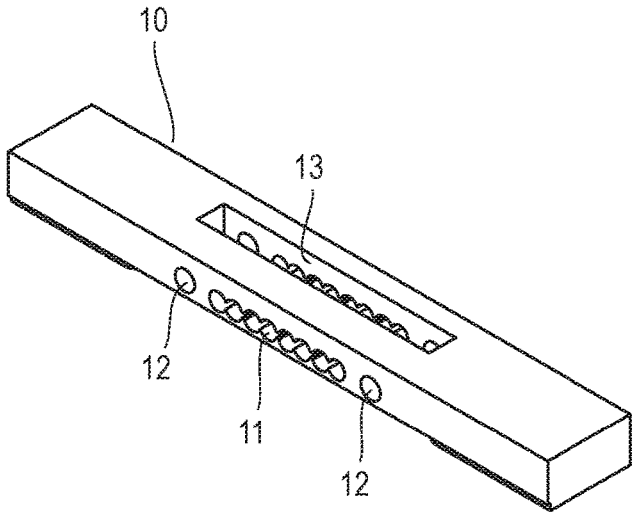
FIG. 1 is a perspective view illustrating a conventional example of a cable alignment component.
Figure 2:
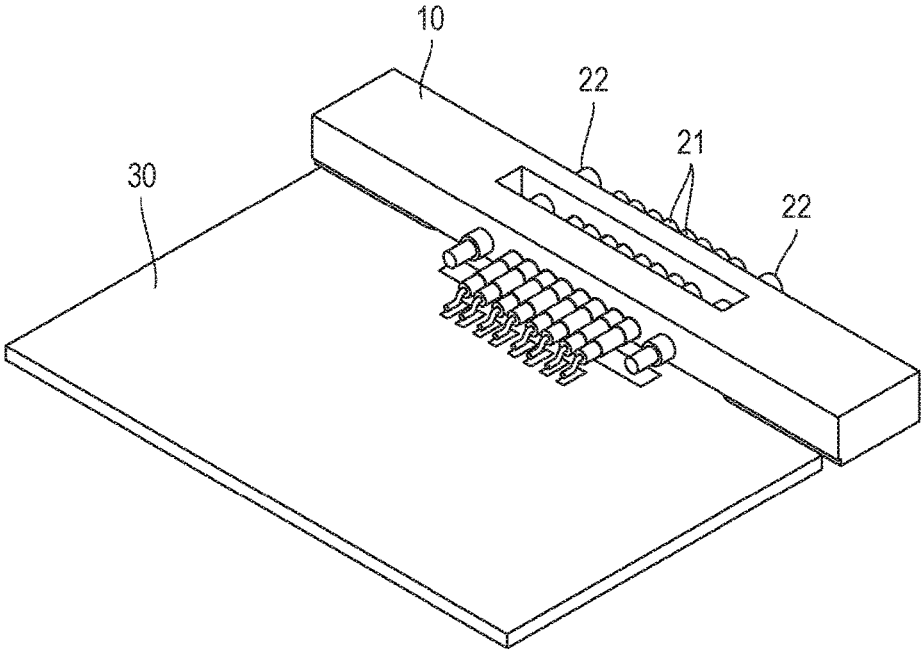
FIG. 2 is a perspective view illustrating a state that the cable alignment component of FIG. 1 to which cables are attached is attached to a substrate.
Figure 3A:
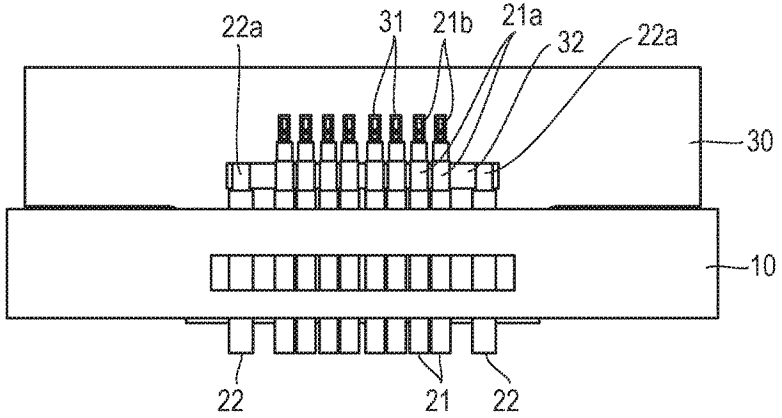
FIG. 3A is a plan view of the state illustrated in FIG. 2.
Figure 3B:
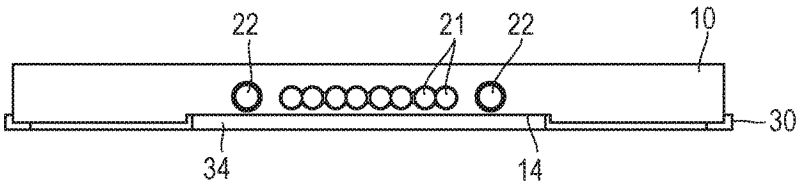
FIG. 3B is a front elevational view of the state illustrated in FIG. 2.
Figure 3C:
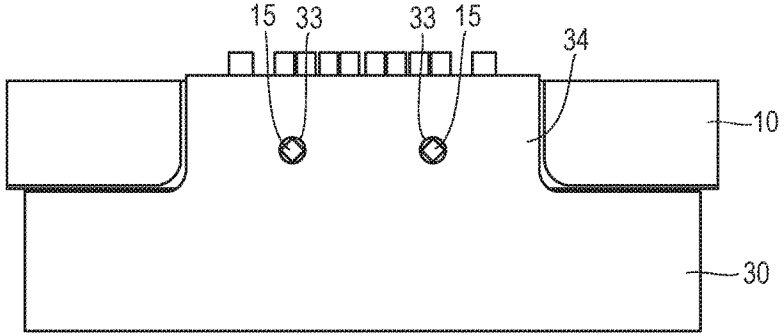
FIG. 3C is a bottom view of the state illustrated in FIG. 2.
Figure 3D:
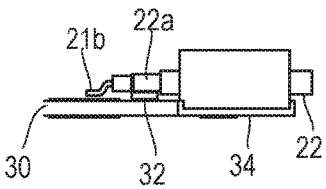
FIG. 3D is a lateral view of the state illustrated in FIG. 2.
Figure 4:
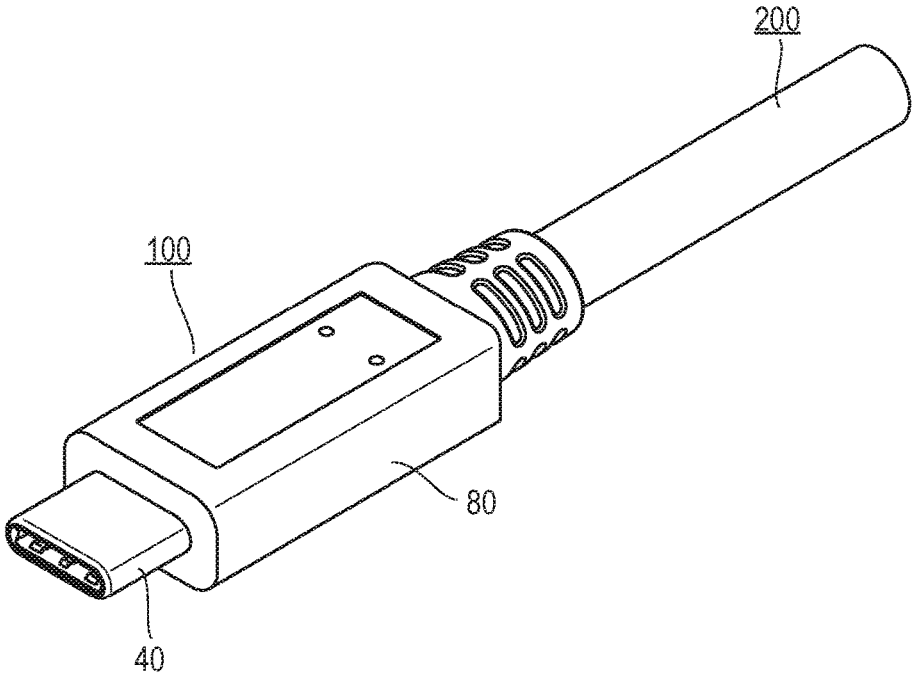
FIG. 4 is a perspective view illustrating a connector according to an embodiment of the present invention.
Figure 5A:
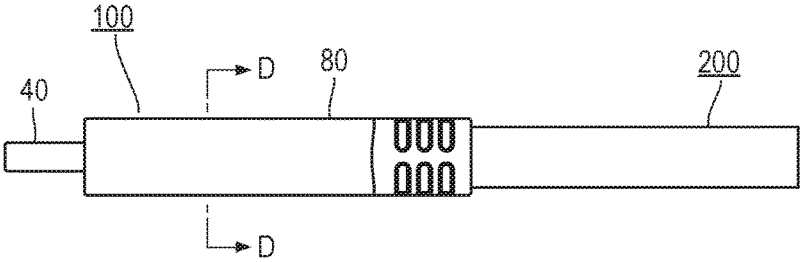
FIG. 5A is a lateral view of the connector illustrated in FIG. 4.
Figure 5B:
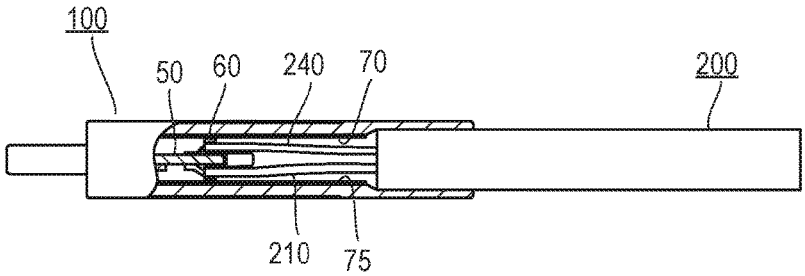
FIG. 5B is a partial sectional view of the connector illustrated in FIG. 5A.
Figure 5C:
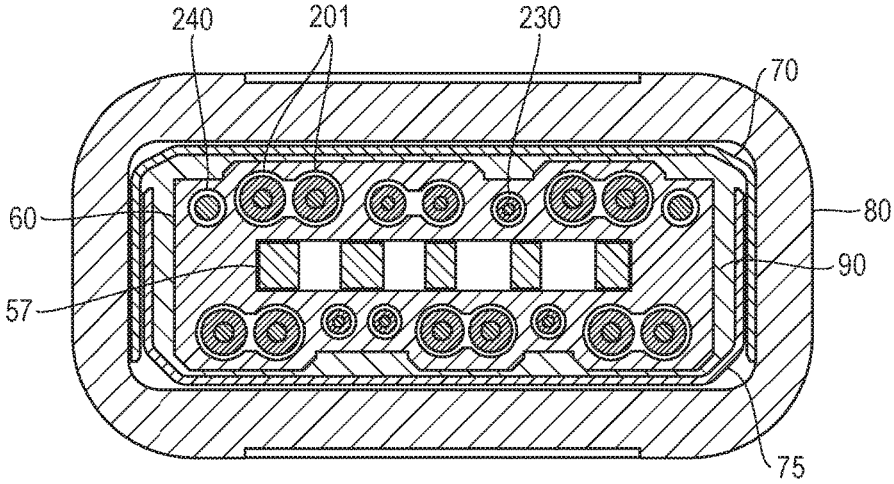
FIG. 5C is an enlarged sectional view taken along the line D-D of FIG. 5A.
Figure 6:
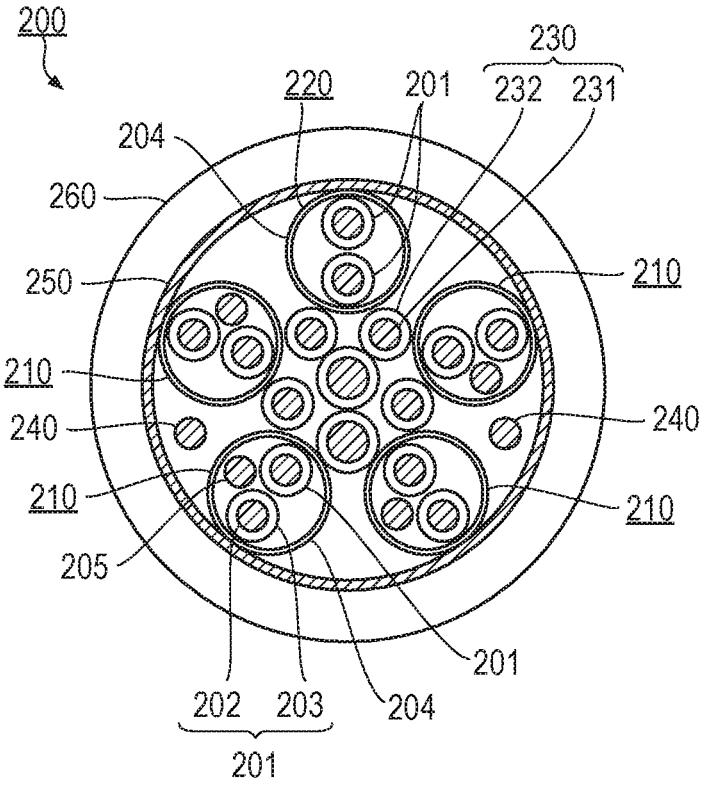
FIG. 6 is a sectional view for illustrating the configuration of a composite cable which is attached to the connector illustrated in FIG. 4.

FIG. 6 schematically illustrates a cross section of the composite cable 200. In this example, the composite cable 200 includes four shielded cables 210 each including a drain wire, one shielded cable 220 not including a drain wire, six discrete cables 230, and two drain cables 240. In FIG. 6, a reference numeral 250 denotes a braid, and reference numeral 260 denotes a jacket.

In this example, the shielded cables 210 each have the configuration in which the drain wire and signal cables which are twisted pair wires are wound with a tape-like shielding material. In this example, the shielded cable 220 has the configuration in which signal cables which are twisted pair wires are wound with a tape-like shielding material. In FIG. 6, a reference numeral 201 denotes a signal cable, a reference numeral 202 denotes a conductive wire, a reference numeral 203 denotes an insulator coating the conductive wire 202, a reference numeral 204 denotes a shielding material, and a reference numeral 205 denotes a drain wire. The shielding material 204 has the configuration in which aluminum foil is formed on a PET film.

The discrete cables 230 each have the configuration in which one conductive wire 231 is coated with an insulator 232. Though the detailed illustration of the drain cable 240 is omitted, each of the drain cables 240 is formed of a bundle of conductive wires and is a bare wire without a coating.

The connector 100 includes a fitting portion 40 which is to be fitted with a mating connector, a substrate 50, a locator 60, back shells 70 and 75, an outer mold 80, and an inner mold 90. As illustrated in FIGS. 4 and 5A to 5C, the outer mold 80 constitutes the outer shape of the connector 100. The fitting portion 40 protrudes from the front end face of the outer mold 80. The "front-rear direction" of the outer mold 80 is defined as the extending direction of the composite cable 200 (that is, the side closer to the composite cable 200 is defined as "rear" and the side farther from the composite cable 200 is defined as "front").

Figure 7:
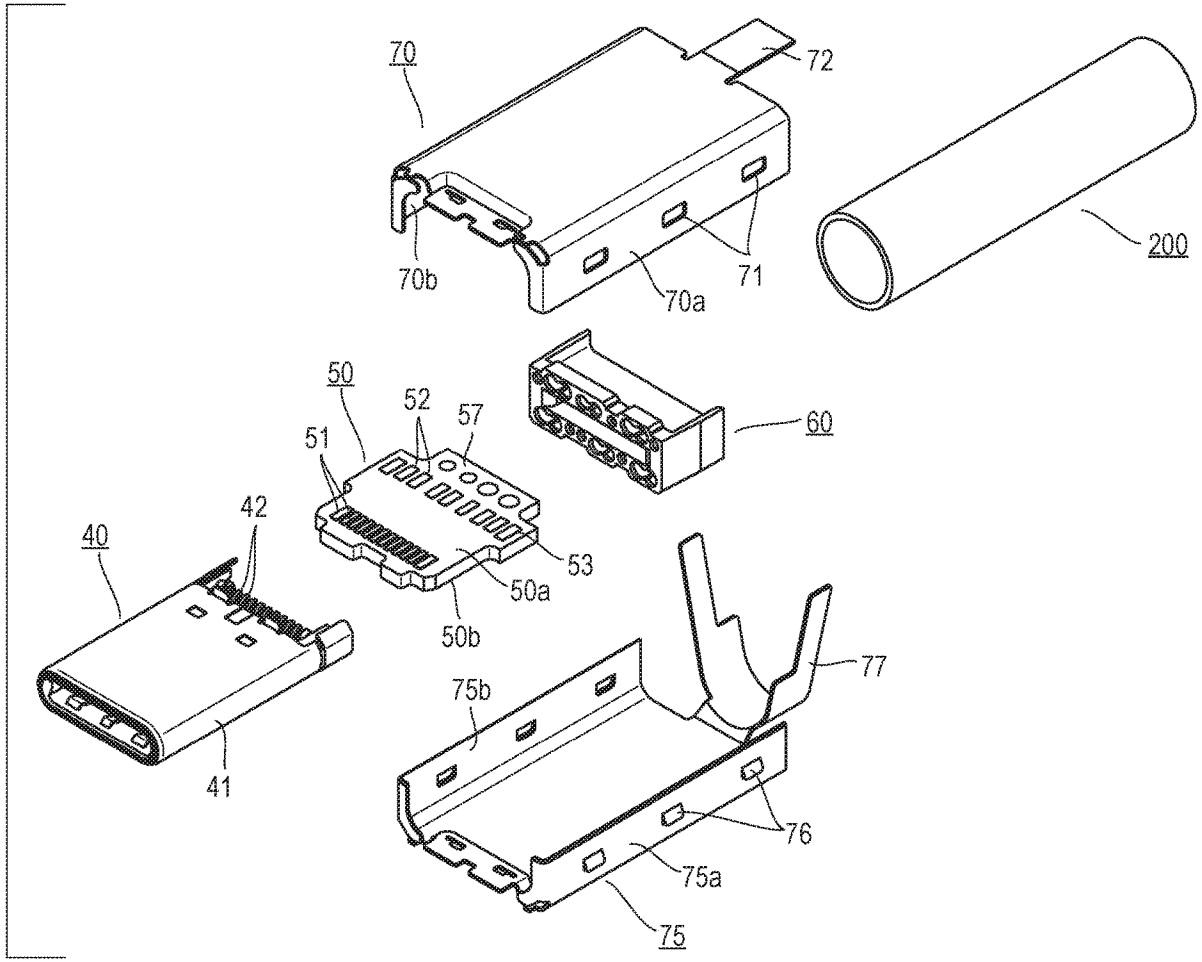
FIG. 7 is an exploded perspective view in which a part of the connector illustrated in FIG. 4 is omitted.

FIG. 7 illustrates the composite cable 200 and each part of the connector 100 which is disassembled, but illustration of the outer mold 80 and the inner mold 90 is omitted. In FIG. 7, illustration of the internal configuration of the composite cable 200 is omitted.

The fitting portion 40 includes a shell 41 which has a tubular shape. Inside the shell 41, contacts 42 which come into contact with contacts of a mating connector are aligned. Rear ends of the contacts 42 are exposed to the outside of the shell 41.

On the front end side (the side farther from the composite cable 200) of an upper surface 50*a* of the substrate 50, electrodes 51 which come into contact with the contacts 42 of the fitting portion 40 are arranged in a row. An electrode array 53 is formed on the rear end side (the side closer to the composite cable 200) of the upper surface 50*a*. In the electrode array 53, electrodes 52 are arranged in a row. Each of the electrodes 52 is connected to a corresponding one of the conductive wires in the composite cable 200. The electrode array 53 includes nine electrodes 52 in this example.

Figure 10A:
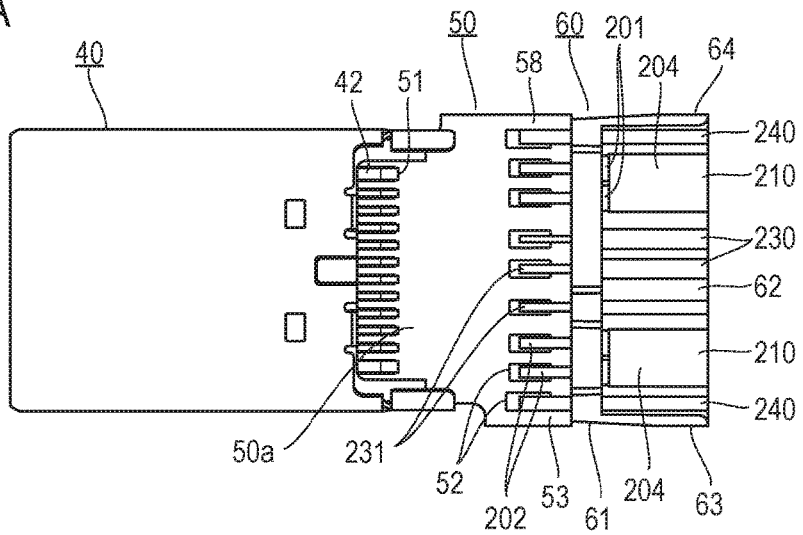
FIG. 10A is a plan view of the state illustrated in FIG. 9 that the substrate to which the locator is attached is attached to the fitting portion.
Figure 10B:
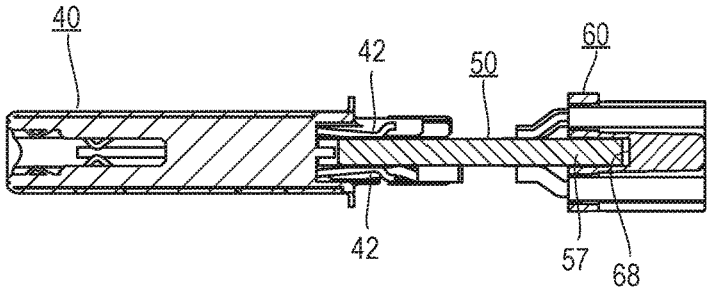
FIG. 10B is a sectional view of the state illustrated in FIG. 9.
Figure 10C:
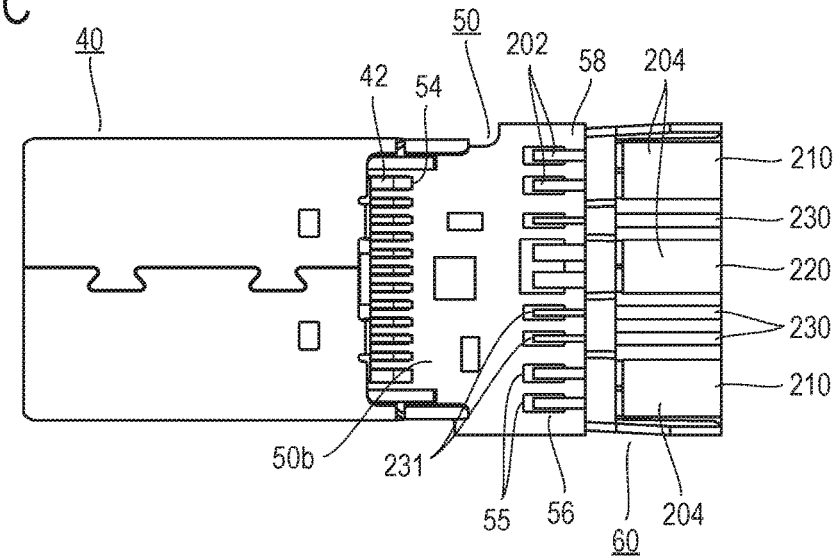
FIG. 10C is a bottom view of the state illustrated in FIG. 9.

Though not seen in FIG. 7, electrodes 54 which come into contact with the contacts 42 of the fitting portion 40 are arranged in a row on the front end side of a lower surface 50*b* of the substrate 50 (see FIG. 10C). On the rear end side of the lower surface 50*b*, an electrode array 56 is formed. In the electrode array 56, electrodes 55 are arranged in a row.

Each of the electrodes 55 is connected to a corresponding one of the conductive wires in the composite cable 200. The electrode array 56 includes eight electrodes 55 in this example. Illustration of wiring patterns connecting the electrodes 51 and 54 on the front end side and the electrodes 52 and 55 on the rear end side is omitted.

A narrow width portion 57 is formed at the rear end of the substrate 50. The width of the narrow width portion 57 is smaller than the width of the central portion of the substrate 50. The narrow width portion 57 functions as a positioning means of the locator 60 with respect to the substrate 50.

Figure 8E:
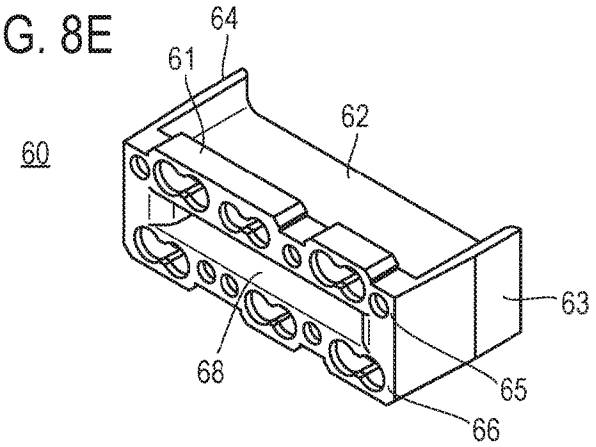
FIG. 8E is a perspective view of the locator in FIG. 7.
Figure 8D:
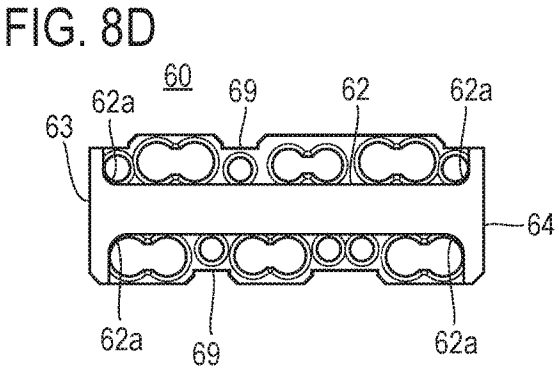
FIG. 8D is a rear view of the locator in FIG. 7.
Figure 8C:
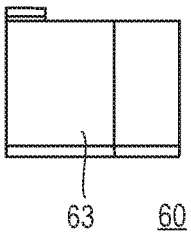
FIG. 8C is a lateral view of the locator in FIG. 7.
Figure 8B:
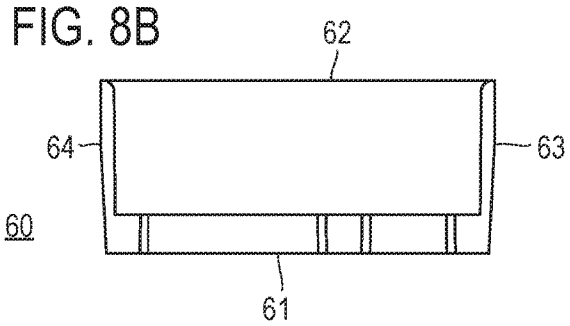
FIG. 8B is a plan view of the locator in FIG. 7.

The locator 60 is made of insulating resin. As illustrated in detail in FIGS. 8A to 8E, the locator 60 includes a base portion 61, a plate-like portion 62, and lateral walls 63 and 64. The plate-like portion 62 and the lateral walls 63 and 64 each have a rectangular flat plate shape. The plate-like portion 62 connects the lateral wall 63 and the lateral wall 64 which are opposed to each other, and the plate-like portion 62 and the lateral walls 63 and 64 form a partition wall portion. The cross section of the partition wall portion in a plane orthogonal to the extending direction of the composite cable 200 has the H shape. The base portion 61 is positioned at one end of the partition wall portion in the extending direction of the composite cable 200 (that is, the front end of the locator 60) and has a wall shape. A total of four corner portions formed by the plate-like portion 62 and the lateral walls 63 and 64 are curved surfaces 62*a* of a quarter arc (see FIG. 8D). Hereinafter, the "width direction" of the locator 60 is defined as a direction orthogonal to the extending direction of the composite cable 200 and orthogonal to the normal direction of the plate-like portion 62. The "height direction" of the locator 60 is defined as the normal direction of the plate-like portion 62. The "front-rear direction" of the locator 60 is defined as the extending direction of the composite cable 200 (that is, the side closer to the composite cable 200 is defined as "rear" and the side farther from the composite cable 200 is defined as "front").

Two through hole arrays are formed in the base portion 61. Each of the two through hole arrays 65 and 66 includes through holes which penetrate in the front-rear direction of the locator 60. In each of the through hole arrays 65 and 66, through holes are arranged in a row in the width direction of the locator 60. The two through hole arrays 65 and 66 are arranged in the height direction of the locator 60. The plate-like portion 62 is positioned between the two through hole arrays 65 and 66. The diameters of the through holes are classified into three types, and reference characters 67*a*, 67*b*, and 67*c* are given to through holes having a small diameter, a medium diameter, and a large diameter, respectively. In the through hole array 65 on the upper stage, through holes 67*a*, 67*c*, 67*c*, 67*b*, 67*b*, 67*a*, 67*c*, 67*c*, and 67*a* are arranged from left to right in FIG. 8A. Further, in the through hole array 66 on the lower stage, the through holes 67*c*, 67*c*, 67*a*, 67*a*, 67*c*, 67*c*, 67*a*, 67*c*, and 67*c* are arranged from left to right in FIG. 8A.

Figure 8A:
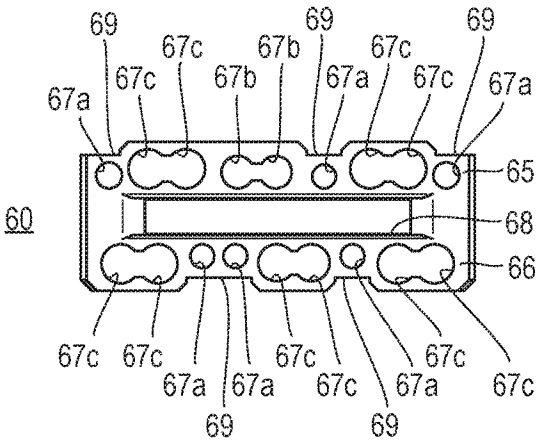
FIG. 8A is a front elevational view of a locator in FIG. 7.
Figure 9:
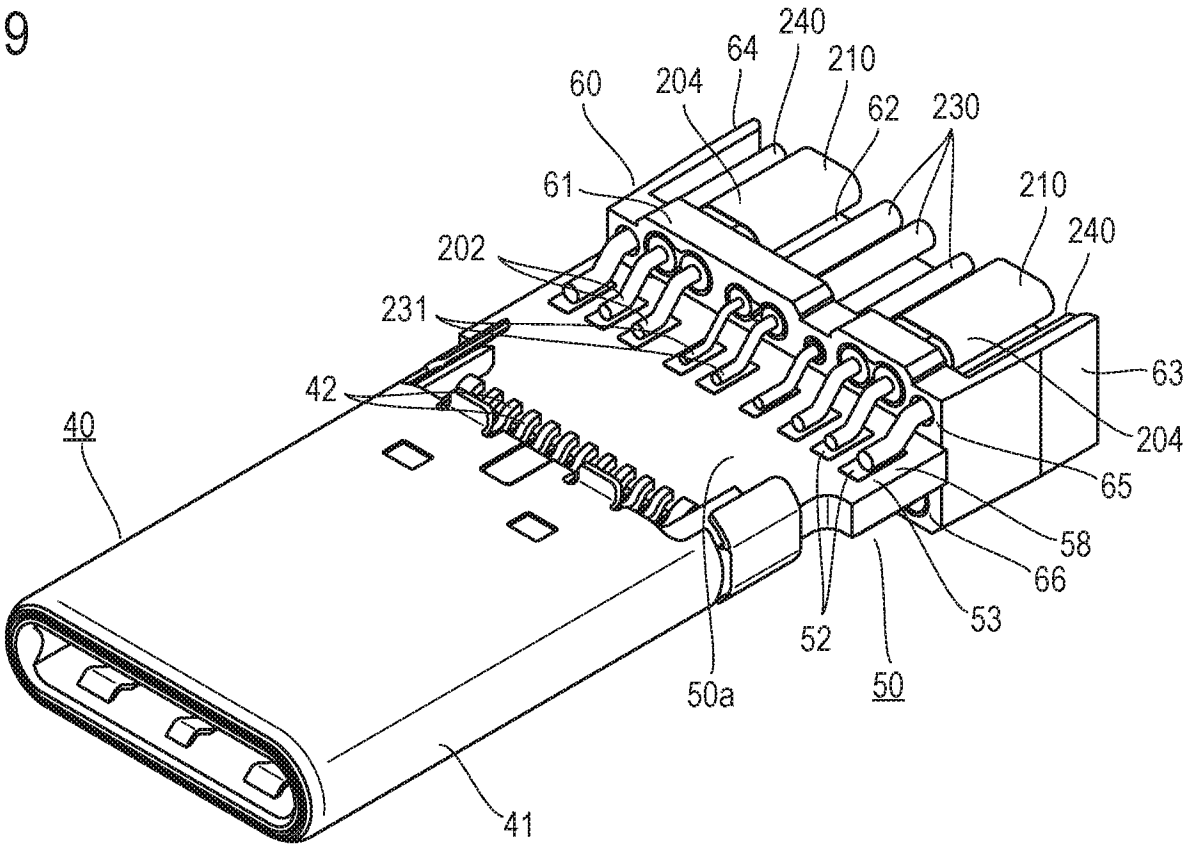
FIG. 9 is a perspective view illustrating a state that a locator to which cables are attached is attached to a substrate and the substrate is attached to a fitting portion.

Each of the through hole arrays 65 and 66 includes nine through holes in this example. The large-diameter through holes 67*c* and 67*c* adjacent to each other and the medium-diameter through holes 67*b* and 67*b* adjacent to each other have the configuration in which the adjacent through holes are connected with each other as illustrated in FIG. 8A in this example.

Further, an insertion hole 68 and grooves 69 are formed in the base portion 61. The insertion hole 68 has a rectangular opening elongating in the width direction of the locator 60 and is formed between the two through hole arrays 65 and 66. The depth of the insertion hole 68 partially reaches the plate-like portion 62. The narrow width portion 57 is inserted into the insertion hole 68. The insertion hole 68 functions as a positioning means of the substrate 50 with respect to the locator 60. The groove 69 is formed in the vicinity of the small-diameter through hole 67*a* at the edge of the base portion 61. In this example, a total of five grooves 69 are formed. The edge of the base portion 61 is cut out by the grooves 69.

Each of the back shells 70 and 75 has a staple-like cross section. When the back shells 70 and 75 are engaged with each other, a rectangular tubular shield is formed. Each of the back shells 70 and 75 is formed with a metal plate. Three windows 71 are formed on each of lateral walls 70*a* and 70*b*, which are opposed to each other, of the back shell 70. Three claws 76 are formed on each of lateral walls 75*a* and 75*b*, which are opposed to each other, of the back shell 75. The claws 76 of the back shell 75 are caught in the windows 71 of the back shell 70, whereby the back shell 70 and the back shell 75 are engaged with each other. A fixing piece 77 is formed in a protruded manner at the rear end (the end portion closer to the composite cable 200) of the back shell 75. The fixing piece 77 has a U-shaped cross section. A pressing piece 72 protrudes from the rear end (the end portion closer to the composite cable 200) of the back shell 70. Both end portions of the fixing piece 77 are wound around the pressing piece 72 and the composite cable 200, whereby the fixing piece 77 fixes the composite cable 200. The pressing piece 72 around which the fixing piece 77 is wound presses the composite cable 200.

The assembly of respective components will now be described.

FIGS. 9 and 10A to 10C illustrate a state that the cables in the composite cable 200 are attached to the locator 60, the locator 60 is attached to the substrate 50, and the substrate 50 is attached to the fitting portion 40. Illustration of portions of the cables positioned behind the rear end of the locator 60 is omitted. Hereinafter, this assembly will be described in the order of steps.

(1) First, the jacket 260 and the braid 250 at the end of the composite cable 200 are removed and thus, the shielded cables 210 and 220, the discrete cables 230, and the drain cables 240 are taken out from the composite cable 200.

(2) Subsequently, the shielding material 204 at the ends of the shielded cables 210 and 220 is removed and thus, the signal cables 201 are taken out from the shielded cables 210 and 220. An exposed portion of the drain wire 205 in the shielded cable 210 is removed by cutting in this example.

(3) Each of the signal cables 201, the discrete cables 230, and the drain cables 240 is inserted into one corresponding through hole among the through holes of the locator 60. In this example, the drain cables 240 are respectively inserted through the through holes 67*a* at both ends of the through hole array 65, and the signal cables 201 of the four shielded cables 210 and the signal cables 201 of the shielded cable 220 are respectively inserted through the five pairs of through holes 67*c* and 67*c*. The six discrete cables 230 are inserted through remaining four through holes 67*a* and two through holes 67*b* of the through hole arrays 65 and 66.

Since the drain cable 240 is not coated and is composed of a bundle of conductive wires (stranded wire) as described above, a state that the bundle is untwisted and it becomes difficult to pass the drain cable 240 through the through hole 67*a* may be generated. However, the drain cables 240 are respectively inserted through the through holes 67*a* positioned at both ends of the through hole array 65, in this example. The drain cables 240 are guided to the through holes 67*a* by the lateral walls 63 and 64 and the curved surfaces 62*a*, so that the drain cables 240 are easily passed through the through holes 67*a*.

(4) Next, the cables are fixed to the locator 60 with an adhesive. The adhesive is applied to each of the upper surface and the lower surface of the plate-like portion 62 which is an adhesive application portion, whereby the shielded cables 210 and 220, the discrete cables 230, and the drain cables 240 are fixed on the locator 60. The shielded cables 210 and 220 are fixed to the plate-like portion 62 in a state that the end of the shielding material 204 is positioned on the plate-like portion 62. In FIGS. 9 and 10A to 10C, illustration of the adhesive is omitted.

(5) Subsequently, termination processing is performed with respect to each cable. The insulator 203 of each of the signal cables 201 and the insulator 232 of each of the discrete cables 230 are removed so as to take out the conductive wires 202 and 231 respectively. Then, the conductive wires 202 and 231 and the drain cables 240 are bent as illustrated in FIGS. 9 and 10A to 10C.

(6) Next, the locator 60 holding the cables is attached to the substrate 50. The substrate 50 and the locator 60 are mutually positioned and fixed by fitting the narrow width portion 57 of the substrate 50 into the insertion hole 68 of the locator 60. The conductive wires 202 and 231 and the drain cables 240 are each located on one corresponding electrode among the electrodes 52 and 55 as illustrated in FIGS. 10A to 10C.

(7) Subsequently, the conductive wires 202 and 231 and the drain cables 240 are soldered to the electrodes 52 and 55. Here, illustration of the solder is omitted in FIGS. 9 and 10A to 10C.

(8) Next, by inserting the front end side of the substrate 50 into the fitting portion 40, the substrate 50 and the fitting portion 40 are connected. The front end side of the substrate 50 is sandwiched by the contacts 42 of the fitting portion 40. The electrodes 51 and 54 on the front end side of the substrate 50 come into contact with the contacts 42.

In this manner, the configuration illustrated in FIGS. 9 and 10A to 10C is completed.

Next, the back shells 70 and 75 are attached to the configuration, in which the locator 60, the substrate 50, and the fitting portion 40 are joined together in a manner to hold the cables, and further, the inner mold 90 and the outer mold 80 are formed.

As described above, when the back shells 70 and 75 are engaged with each other, a rectangular tubular shield is formed. A part of the fitting portion 40, the substrate 50, the locator 60, and the ends of the cables are accommodated in the rectangular tubular shield. Then, a space inside the rectangular tubular shield (a portion where a part of the fitting portion 40, the substrate 50, the locator 60, and the ends of the cables are not present) is filled with a resin material to form the inner mold 90 (see FIG. 5C). The base portion 61 of the locator 60 is sandwiched between the back shell 70 and the back shell 75. As described above, since the grooves 69 are formed in the base portion 61, the grooves 69 ensure a flow, in the front-rear direction (the connection direction of the locator 60, the substrate 50, and the fitting portion 40), of the resin material at the time of filling. Accordingly, the space inside the back shells 70 and 75 can be favorably filled with the resin material.

Finally, the outer mold 80 is formed. Through the above-described procedure, the connector 100 illustrated in FIG. 4 and FIGS. 5A to 5C is completed.

As described above, the connector 100 of this example is attached to ends of cables including shielded cables. The connector 100 includes the locator 60 having the shape illustrated in FIGS. 8A to 8E. Advantages a) and b) below are recognized due to the presence of the locator 60 having the shape illustrated in FIGS. 8A to 8E.

a) It is possible to favorably position conductive wires of cables to be connected, with respect to the electrodes 52 and 55 of the substrate 50.

b) A connection portion where the conductive wires are connected to the electrodes 52 and 55, that is, a wire connection portion 58 (see FIGS. 9 and 10A to 10C) on the substrate 50 is positioned in front of the through hole arrays 65 and 66 of the base portion 61, on the side opposite to the plate-like portion 62 of the base portion 61, in the connector 100. Thus, the existence of the base portion 61 prevents the shielding material 204 of each of the shielded cables 210 and 220 from protruding toward the wire connection portion 58. Accordingly, the shielding material 204 can be brought as close as possible to the wire connection portion 58 while securing insulation between the shielding material 204 and the wire connection portion 58, as illustrated in FIGS. 9 and 10A to 10C. That is, prevention of short circuit and improvement of shielding performance can be simultaneously achieved.

In the embodiment described above, the locator 60 includes the base portion 61 in which the through hole arrays 65 and 66 are formed, the plate-like portion 62 having a plate surface parallel to the plate surface of the substrate 50, and the lateral walls 63 and 64. The shape of the locator 60 is not limited to this example. For example, the locator can adopt the simple configuration that does not include the lateral walls 63 and 64 and the plate-like portion 62 which is parallel to the plate surface of the substrate 50.

Figure 11:
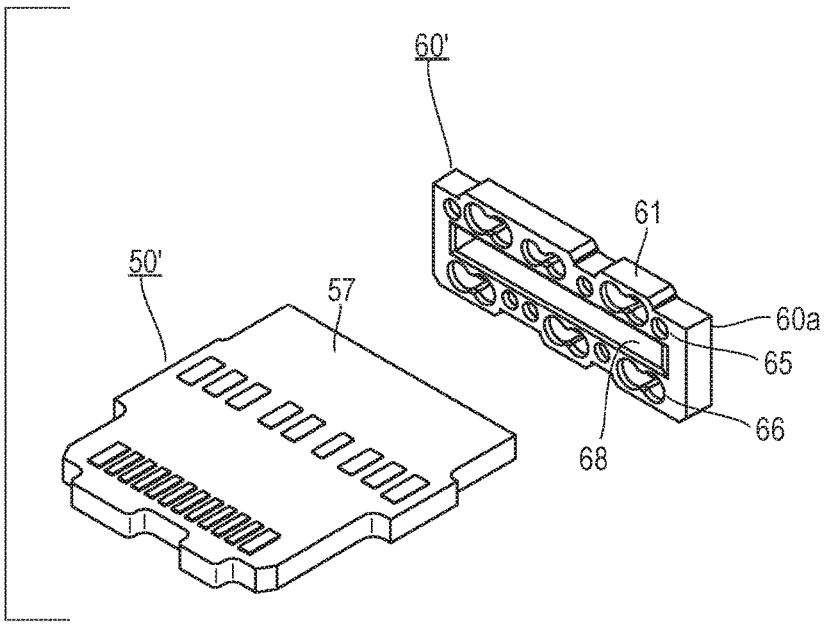
FIG. 11 illustrates another configuration example of the locator and the substrate (Modification 1).

FIG. 11 illustrates a locator 60', which has the simple configuration, together with a substrate 50'. The locator 60' has a shape including only the base portion 61 in the locator 60. In the locator 60', an adhesive application portion to which an adhesive is applied is a wall surface 60*a* on which openings of the through holes are located on the side opposite to the wire connection portion. In this example, the width of the opening of the insertion hole 68 and the width of the narrow width portion 57 of the substrate 50' are increased. Accordingly, the narrow width portion 57 of the substrate 50' which is inserted through the insertion hole 68 functions as a receiving surface of the adhesive.

Figure 12:
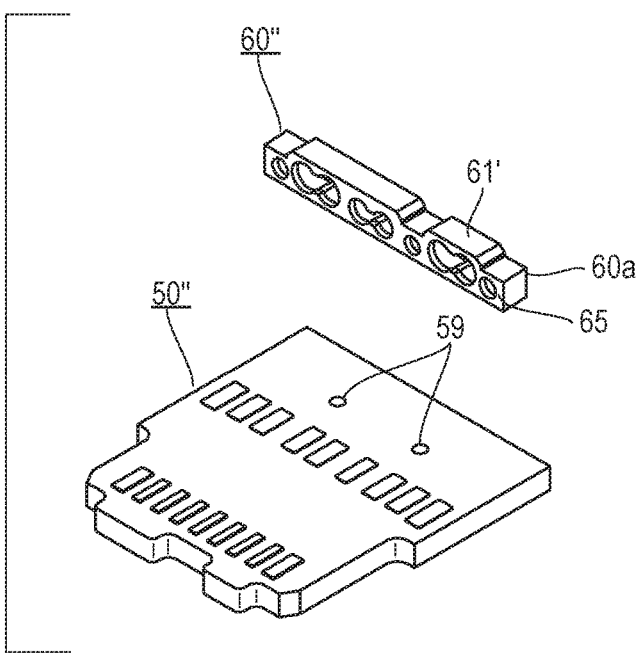
FIG. 12 illustrates still another configuration example of the locator and the substrate (Modification 2).

FIG. 12 illustrates a locator 60", which includes only one through hole array 65, together with a substrate 50". The locator 60" has a shape including only the base portion 61' in which the through hole array 65 is formed. The locator 60" may be adopted depending on the number of cables in the composite cable 200. In the locator 60", an adhesive application portion to which an adhesive is applied is the wall surface 60*a* on which openings of the through holes are located on the side opposite to the wire connection portion, as is the case with the locator 60'. In this example, two bosses (not visible in FIG. 12) formed on the lower surface of the locator 60" and two holes 59 formed in the substrate 50" are positioning means respectively and the locator 60" and the substrate 50" are positioned to each other by fitting the bosses to the holes 59.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A cable harness comprising:

cables including a shielded cable and one or more cables other than the shielded cable, the shielded cable including one or more signal cables shielded with a tape-shaped shielding material, and the tape-shaped shielding material including a film and metal foil formed thereon and being spirally wound around the one or more signal cables; and a connector attached to ends of the cables including the shielded cable and the one or more cables other than the shielded cable, wherein:

the connector includes:

a fitting portion for connecting with a mating connector corresponding to the connector;

a substrate connecting to the fitting portion;

a locator connected to the substrate;

one or two electrode arrays each formed on one corresponding surface of the substrate and each having electrodes arranged in a row;

a first positioning portion included in the substrate;

a wall-shaped base portion with one or two through-hole arrays formed therein, the wall-shaped base portion being included in the locator and each of the one or two through-hole arrays having through holes arranged in a row; and a second positioning portion included in the locator;

each of the one or more signal cables of the shielded cable and the one or more cables other than the shielded cable is inserted through a corresponding one of the through holes;

the substrate and the locator are mutually positioned by the first positioning portion and the second positioning portion;

the one or more signal cables of the shielded cable including one or more conductive wires, and the one or more cables of other than the shielded cable including one or more conductive wires;

each of the conductive wires included in the one or more signal cables of the shielded cable and each of the conductive wires included in the one or more cables other than the shielded cable is connected to a corresponding one of the electrodes;

the cables are fixed to the locator with an adhesive that is applied to a part of the locator located on the back of another part of the locator facing the one or two electrode arrays; and the tape-shaped shielding material has a terminal end located in a vicinity of the locator, the base portion preventing the tape-shaped shielding material from protruding toward the one or two electrode arrays.

2. The cable harness according to claim 1, wherein:

the one or two electrode arrays include two electrode arrays;

the one or two through-hole arrays include two through-hole arrays;

one of the two electrode arrays is formed on one surface of the substrate;

another of the two electrode arrays is formed on another surface of the substrate;

the two through-hole arrays formed on the locator face the two electrode arrays respectively;

the first positioning portion is a narrow width portion that is formed on one side of the substrate;

the second positioning portion is an insertion hole that is formed between the two through-hole arrays; and the substrate and the locator are mutually positioned by inserting the narrow width portion into the insertion hole.

3. The cable harness according to claim 1, wherein the adhesive is applied on a plate-like portion of the locator that has a surface parallel to a plate surface of the substrate.

4. The cable harness according to claim 2, wherein the adhesive is applied on a plate-like portion of the locator that has a surface parallel to a plate surface of the substrate.

5. The cable harness according to claim 3, wherein:

a drain cable that is a bundle of conductive wires is included in the cables;

a lateral wall is formed on an edge of the plate-like portion; and the drain cable is guided to a corresponding one of the through holes by a corner portion formed by the plate-like portion and the lateral wall, the corresponding one of the through holes being located on a lateral end of any of the one or more through-hole arrays.

6. The cable harness according to claim 4, wherein:

a drain cable that is a bundle of conductive wires is included in the cables;

a lateral wall is formed on an edge of the plate-like portion; and the drain cable is guided to a corresponding one of the through holes by a corner portion formed by the plate-like portion and the lateral wall, the corresponding one of the through holes being located on a lateral end of any of the one or more through-hole arrays.

7. The cable harness according to claim 1, wherein the part of the locator to which the adhesive is applied is a wall surface on which openings of the through holes are located.

8. The cable harness according to claim 2, wherein the part of the locator to which the adhesive is applied is a wall surface on which openings of the through holes are located.

9. The cable harness according to claim 1, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

10. The cable harness according to claim 2, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

11. The cable harness according to claim 3, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

12. The cable harness according to claim 4, further comprising:

a back shell, wherein; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

13. The cable harness according to claim 5, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

14. The cable harness according to claim 6, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

15. The cable harness according to claim 7, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

16. The cable harness according to claim 8, further comprising:

a back shell; and wherein:

a groove is formed on the locator;

the groove is located in a vicinity of at least one of the through holes that has a diameter smaller than a maximum diameter of the through holes;

the back shell houses a part of the fitting portion, the substrate, the locator, and the ends of the cables; and a space inside the back shell, except for a part of the fitting portion, the substrate, the locator, and the ends of the cables, is filled with a resin material.

* * * * *